US006220835B1

(12) United States Patent
Salmela et al.

(10) Patent No.: US 6,220,835 B1
(45) Date of Patent: Apr. 24, 2001

(54) PORTION CONTROL DISPENSING PUMP

(75) Inventors: Juha K. Salmela, Citrus Heights; Charles E. Bennett, Sacramento; Antonio J. Jepson, Dixon, all of CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 09/467,101

(22) Filed: Dec. 10, 1999

Related U.S. Application Data

(63) Continuation-in-part of application No. 09/422,826, filed on Oct. 21, 1999.

(51) Int. Cl.[7] ..... F04B 39/10
(52) U.S. Cl. ..... 417/545
(58) Field of Search ..... 417/545, 550, 417/437, 553; 222/385

(56) References Cited

U.S. PATENT DOCUMENTS

| | | | | |
|---|---|---|---|---|
| 2,621,889 | * | 12/1952 | Annin | 137/853 |
| 4,869,404 | * | 9/1989 | Elliott | 222/385 |
| 5,380,175 | * | 1/1995 | Amarume | 417/553 |
| 5,381,932 | * | 1/1995 | Humphrey | 222/385 |
| 5,435,466 | * | 7/1995 | Du | 222/385 |
| 5,667,105 | * | 9/1997 | Hartley et al. | 222/148 |
| 5,782,621 | * | 7/1998 | Harris | 417/470 |
| 5,803,312 | * | 9/1998 | Credle, Jr. et al. | 222/129.1 |
| 5,975,360 | * | 11/1999 | Ophardt | 222/83 |
| 6,019,256 | * | 2/2000 | Seltzer | 222/385 |
| 6,102,679 | * | 8/2000 | Brown | 417/550 |

* cited by examiner

*Primary Examiner*—Teresa Walberg
*Assistant Examiner*—Vinod D. Patel
(74) *Attorney, Agent, or Firm*—Townsend and Townsend and Crew LLP

(57) ABSTRACT

A piston is movable to reciprocate in a chamber. The piston has a transfer check valve which permits condiment flow only in a direction from an inlet side of the chamber to an outlet side of the chamber. The inlet side of the chamber includes an inlet coupled to a condiment source. The outlet side of the chamber includes an outlet with an outlet check valve. When the piston is moved from the outlet side to the inlet side of the chamber, the transfer check valve is open to permit condiment flow from the inlet side to the outlet side of the chamber, and the outlet check valve is closed to accumulate condiment therein. Upon accumulation of a desired amount of condiment in the outlet side of the chamber, the piston is moved from the inlet side to the outlet side of the chamber. During that time, the transfer check valve is closed and the outlet check valve is open to dispense the accumulated condiment in the outlet side of the chamber. At the same time, condiment is flowed into inlet side of the chamber. The amount of condiment transferred to the outlet side of the chamber is determined by the piston stroke, and can be controlled to produce a consistent amount for each cycle of accumulating and dispensing condiment. The cycle is repeated to provide dispensing action with simple portion control. The outlet check valve and transfer check valve may be elastomeric check valves.

24 Claims, 5 Drawing Sheets

PORTION CONTROL DISPENSING PUMP

This application is a continuation-in-part of and claims priority from U.S. patent application Ser. No. 09/422,826, filed Oct. 21, 1999, the entire disclosure of which is incorporated herein by reference.

BACKGROUND OF THE INVENTION

This invention relates generally to dispensing systems, and more particularly to a pump for dispensing condiments and the like.

It is often desirable to dispense a condiment or the like by consistent amounts. Both mechanical and electronic devices have been used to control the portion dispensed with varying degrees of success. Some of the devices are rather complex and expensive. Others may be unsuitable for dispensing condiments that contain solids or semi-solids.

SUMMARY OF THE INVENTION

The present invention relates to a pump for dispensing condiments or the like. The pump provides a simple and reliable mechanism for providing consistent portion control in dispensing, and is especially suitable for dispensing condiments that contain solids or semi-solids or particles such as in thousand island dressing and various "secret sauces" favored by restaurants.

The invention provides a reciprocating piston in a chamber. The piston has a transfer check valve which permits condiment flow only in a direction from an inlet side of the chamber to an outlet side of the chamber. The outlet side of the chamber includes an outlet with an outlet check valve. When the piston is moved from the outlet side to the inlet side of the chamber, the transfer check valve is open to permit condiment flow from the inlet side to the outlet side of the chamber, and the outlet check valve is closed to accumulate condiment therein. Upon accumulation of a desired amount of condiment in the outlet side of the chamber, the piston is moved from the inlet side to the outlet side of the chamber. During that time, the transfer check valve is closed and the outlet check valve is open to dispense the accumulated condiment in the outlet side of the chamber. At the same time, condiment is flowed into the inlet side of the chamber. The amount of condiment transferred to the outlet side of the chamber is determined by the piston stroke, and can be controlled to produce a consistent amount for each cycle of accumulating and dispensing condiment. The cycle is repeated to provide dispensing action with simple portion control. The outlet check valve and transfer check valve may be elastomeric check valves as described in U.S. patent application Ser. No. 09/422,826.

In accordance with an aspect of the present invention, a condiment dispensing pump comprises a pump chamber including a cavity having an inlet chamber cavity portion and an outlet chamber cavity portion. The pump chamber has an inlet fluidicly coupled with the inlet chamber cavity portion and an outlet fluidicly coupled with the outlet chamber cavity portion. An outlet check valve is disposed at or near the outlet of the pump chamber, and is openable to permit flow only in a direction from the outlet chamber cavity portion out through the outlet check valve. A piston is disposed in the pump chamber cavity between the inlet chamber cavity portion and the outlet chamber cavity portion. The piston is movable in the pump chamber cavity to reapportion the volume of the pump chamber cavity between the inlet chamber cavity portion and the outlet chamber cavity portion. The piston includes a piston check valve which is openable to permit flow only in a direction from the inlet chamber cavity portion through the piston check valve to the outlet chamber cavity portion.

In some embodiments, the piston is movable between a first position when the inlet chamber cavity portion has a minimum volume and the outlet chamber cavity portion has a maximum volume, and a second position when the inlet chamber cavity portion has a maximum volume and the outlet chamber cavity portion has a minimum volume. The piston check valve is closed and the outlet check valve is open when the piston moves from the first position to the second position to draw a flow from the inlet into the inlet chamber cavity portion and to produce a flow from the outlet chamber cavity portion out through the outlet. The piston check valve is open and the outlet check valve is closed when the piston moves from the second position to the first position to permit flow from the inlet chamber cavity portion to the outlet chamber cavity portion and to prevent backflow through the outlet into the outlet chamber cavity portion.

In specific embodiments, the piston is movable in the pump chamber cavity in a generally linear manner. The piston has a generally constant stroke. An air cylinder is coupled with the piston to move the piston in the pump chamber cavity.

In accordance with another aspect of the invention, a portion control dispensing apparatus comprises a chamber including a cavity having an inlet and an outlet. An outlet check valve is disposed at or near the outlet of the chamber, and is openable to permit flow only in a direction from the chamber cavity out through the outlet check valve. A transfer check valve is disposed in the chamber cavity. The transfer check valve is movable in the chamber cavity between a first position near the inlet and away from the outlet and a second position near the outlet and away from the inlet. The transfer check valve is closed when moved from the first position to the second position and is open when moved from the second position to the first position.

In accordance with another aspect of the invention, a condiment dispensing pump comprises a pump chamber including a cavity having an upstream chamber cavity portion and a downstream chamber cavity portion. The pump chamber has an inlet fluidicly coupled with the upstream chamber cavity portion and an outlet fluidicly coupled with the downstream chamber cavity portion. An outlet valve is disposed at or near the outlet of the pump chamber. A transfer valve is disposed in the pump chamber cavity. The pump includes a mechanism for increasing the volume of the downstream chamber cavity portion and decreasing the volume of the upstream chamber cavity portion when the transfer valve is open and the outlet transfer valve is closed to transfer fluid accumulated in the upstream chamber cavity portion into the downstream chamber cavity portion, and for decreasing the volume of the downstream chamber cavity portion and increasing the volume of the upstream chamber cavity portion when the transfer valve is closed and the outlet valve is open to transfer the fluid in the downstream chamber cavity portion out through the open outlet valve and to draw fluid through the inlet for accumulation in the upstream chamber cavity portion.

In some embodiments, the outlet valve comprises an outlet check valve which is openable to permit flow only in a direction from the downstream chamber cavity portion out through the outlet check valve. The transfer valve comprises an transfer check valve which is openable to permit flow only in a direction from the upstream chamber cavity portion to the downstream chamber cavity portion. In specific embodiments, the outlet check valve and transfer check valve may be elastomeric check valves.

Another aspect of the invention is directed to a method of providing portion control pumping, which comprises providing a transfer valve in a chamber between an inlet disposed at an inlet side of the chamber and an outlet disposed at an outlet side of the chamber. An outlet valve is provided at the outlet. The transfer valve is moved from the inlet side of the chamber to the outlet side of the chamber with the transfer valve closed and the outlet valve open to draw fluid through the inlet into the inlet side of the chamber and dispense fluid from the outlet side of the chamber out through the outlet. The transfer valve is moved from the outlet side of the chamber to the inlet side of the chamber with the transfer valve open and the outlet valve closed to transfer fluid from the inlet side of the chamber through the transfer valve to the outlet side of the chamber.

DESCRIPTION OF THE SPECIFIC EMBODIMENTS

Elastomeric Check Valve

Figure 1:
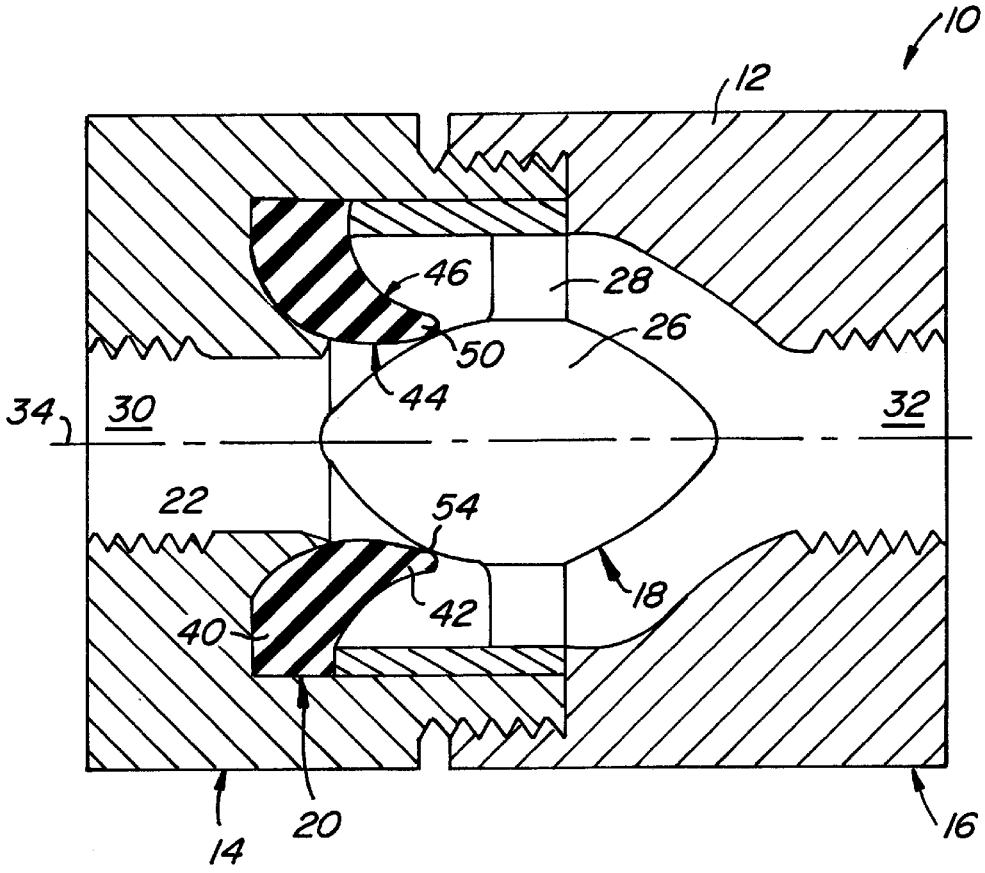
FIG. 1 is a cross-sectional view of a check valve in a rest or closed position illustrating an embodiment of the present invention.

FIG. 1 shows a check valve 10 having a valve body 12 which includes a first body portion 14 connected to a second body portion 16. Disposed in the valve body 12 are a valve stem 18 and a valve seal or resilient valve member 20. The valve seal 20 is disposed in a seat 22 provided in the first body portion 14. The connection of the second body portion 16 to the first body portion 14 advantageously supports and retains the valve seal 20 and valve stem 18 in position. The body portions 14, 16 in the embodiment shown include threads that mate with each other to form an adjustable threaded connection. Of course other types of connections may be used instead. The use of two body portions 14, 16 to form the valve body 12 renders the assembly of the valve 10 more convenient, and makes it easier to replace the components such as the seal 20 or the stem 18.

The valve stem 18 includes a stem body 26 connected to a plurality of spokes 28 that are supported between the body portions 14, 16. The stem body 26 is generally axisymmetric with respect to an axis 34. The stem body 26 is disposed between an upstream chamber 30 and a downstream chamber 32 of the valve 10. Of course, the stem body 26 may be supported inside the valve body 12 by other mechanisms.

Figure 2:
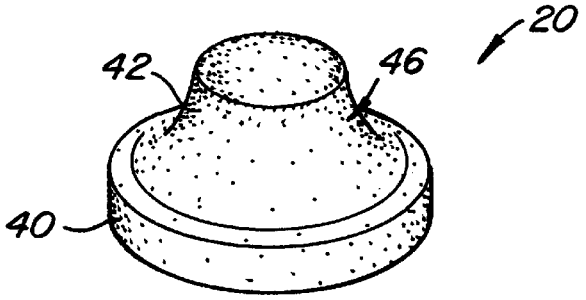
FIG. 2 is a perspective view of the valve seal in the check valve of FIG. 1.

The valve seal 20 is disposed between the valve body 12 (body portion 14 in this embodiment) and the stem body 26. As shown in FIGS. 1 and 2, the valve seal 20 is an annular member which is generally concentric with the valve stem body 26. The seal 20 includes a proximal portion 40 that is attached to or held by the body portion 14 of the valve body 12 at the seat 22. The distal portion 42 of the seal 20 is movable, as discussed in more detail below. The seal 20 separates the upstream chamber 30 from the downstream chamber 32. The seal 20 has on an upstream side an upstream surface 44 at least partially exposed to the upstream chamber 30, and has on a downstream side a downstream surface 46 at least partially exposed to the downstream chamber 32. The seal 20 includes a distal end 50 in the distal portion 42. The distal end 50 is disposed generally between the upstream surface 44 and the downstream surface 46. In a specific embodiment, the upstream surface 44 is generally convex and the downstream surface 46 is generally concave.

The valve seal 20 is resilient, and includes a flexible material which resiliently biases the seal 20 with a resilient biasing force toward the rest position shown in FIG. 1. The seal 20 includes a sealing surface in the distal portion 42 and adjacent the distal end 50. In the rest position, the sealing surface is in contact with the contact surface 54 of the stem body 26 to prevent backflow from the downstream chamber 32 to the upstream chamber 30.

Figure 3:
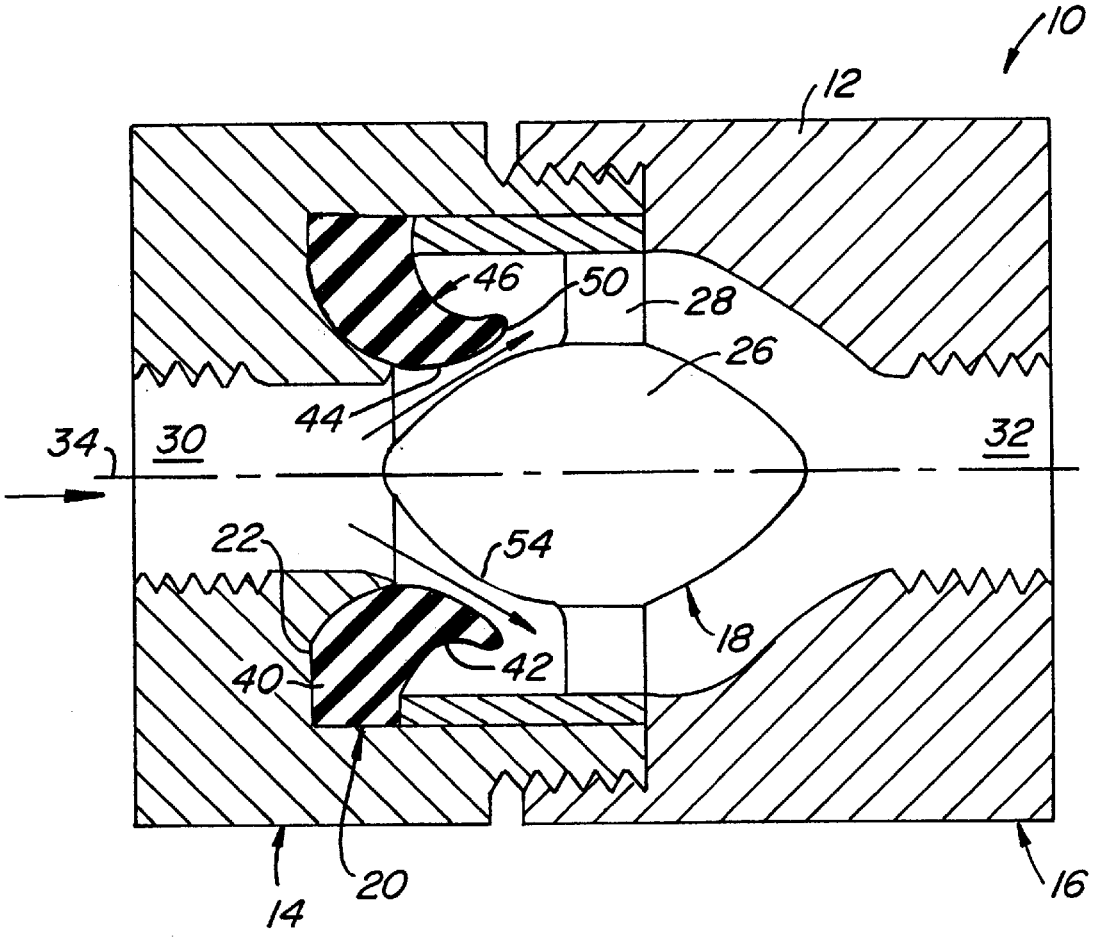
FIG. 3 is a cross-sectional view of the check valve of FIG. 1 in an open position.

FIG. 3 shows the valve seal 20 in the open position with the sealing surface being spaced from the contact surface 54 of the stem body 26 to permit fluid flow from the upstream chamber 30 to the downstream chamber 32. The distal portion 42 of the valve seal 20 moves to the open position when the pressure in the upstream chamber 30 is sufficiently large compared to the pressure in the downstream chamber 32 to overcome the resilient biasing force of the seal 20 biasing it toward the closed position.

To facilitate movement between the open position and the closed position, the distal portion 42 of the seal 20 is typically more flexible than the proximal portion 40. In the specific embodiment shown, the distal portion 42 is smaller in cross section than the proximal portion 40. The cross section of the seal 20 preferably decreases in size generally gradually from the proximal portion 40 to the distal portion 42. The seal 20 is desirably a single-piece member having a generally homogeneous material that is compatible with the condiment. Suitable materials include elastomeric materials such as silicone and the like.

For an annular seal 20, the sealing surface is peripheral. In the embodiment shown in FIGS. 1–3, the sealing surface is generally inward-facing, while the contact surface 54 of the stem body 26 is generally outward-facing. The contact surface 54 is generally conical in a preferred embodiment.

In operation, the resilient biasing force of the resilient seal 20 biases the distal portion 42 toward the rest position with the sealing surface contacting the contact surface 54 of the valve stem 18, as seen in FIG. 1. During condiment flow, the pressure in the upstream chamber 30 builds up (e.g., by activating a condiment pump) and acts upon the upstream surface 44 of the seal. When the upstream pressure is sufficiently larger than the downstream pressure in the downstream chamber 32, it overcomes the biasing force of the resilient seal 20 and moves the distal portion 42 of the seal 20 away from the valve stem 18, as shown in FIG. 3.

When the upstream pressure drops (e.g., by deactivating the condiment pump), the seal 20 returns to the rest position as shown in FIG. 1. If the downstream pressure becomes greater than the upstream pressure, it may tend to move the distal portion 42 of the seal 20 toward the upstream chamber 30 to form an opening for backflow to occur. The downstream pressure does not separate the sealing surface from the contact surface 54 of the valve stem 18, however, because the pressure acts on the downstream surface 46, resulting in a force that has a component oriented generally toward the contact surface 54. As a result, the downstream pressure helps maintain the contact between the sealing surface of the seal 20 and the contact surface 54 of the stem 18. The conical shape of the contact surface 54 is beneficial because it essentially prevents exposure of any part of the seal 20 (i.e., the inward-facing part of the distal portion) to the downstream pressure which would result in a force that separates the sealing surface from the contact surface 54 of the stem 18.

Portion Control Pump

Figure 4:
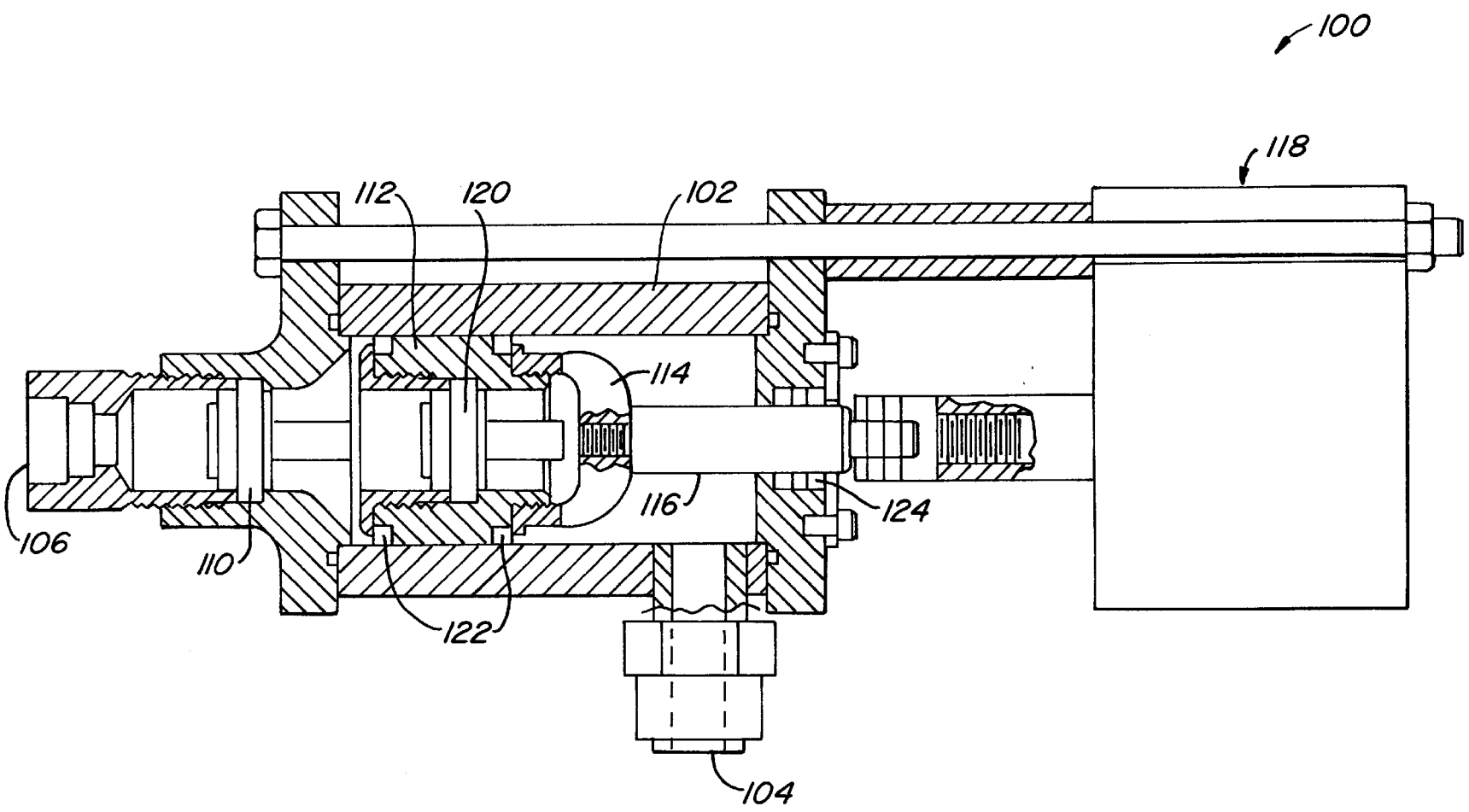
FIG. 4 is a cross-sectional view of a pump illustrating an embodiment of the present invention.

FIG. 4 shows a portion control apparatus or pump 100 for providing consistent portion control in dispensing a condiment or the like. The pump 100 typically has a generally symmetrical configuration, and includes a pump chamber 102 having a chamber cavity which is typically cylindrical with a circular cross-section. The chamber 102 includes an inlet 104 which is coupled to a condiment source, and an outlet 106 which may be further coupled to a dispensing device. The inlet 104 and outlet 106 desirably are disposed near opposite ends of the chamber 102. An outlet valve 110 is disposed at or near the outlet 106. The outlet valve 110 is preferably a check valve that permits flow only in a direction from the chamber cavity out through the outlet check valve 110. In a specific embodiment, the outlet check valve 110 is an elastomeric check valve.

Disposed inside the chamber cavity is a piston 112, which is connected to a yoke 114 coupled to a shaft 116. The shaft 116 extends through an opening of the chamber 102 and is coupled to an air cylinder 118. The piston 112 includes a piston valve 120, which is preferably a transfer check valve that permits flow only in a direction from the side of the chamber cavity adjacent the inlet 104 to the side of the chamber adjacent the outlet 106. In a specific embodiment, the transfer check valve 120 is an elastomeric check valve. The piston 112 desirably makes sealing contact with the interior wall of the chamber 102 with piston seals 122 in the form of O-rings, lip seals, or the like. Shaft seals 124 are desirably provided between the shaft 116 and the opening of the chamber 102 to prevent leakage.

Figure 5A:
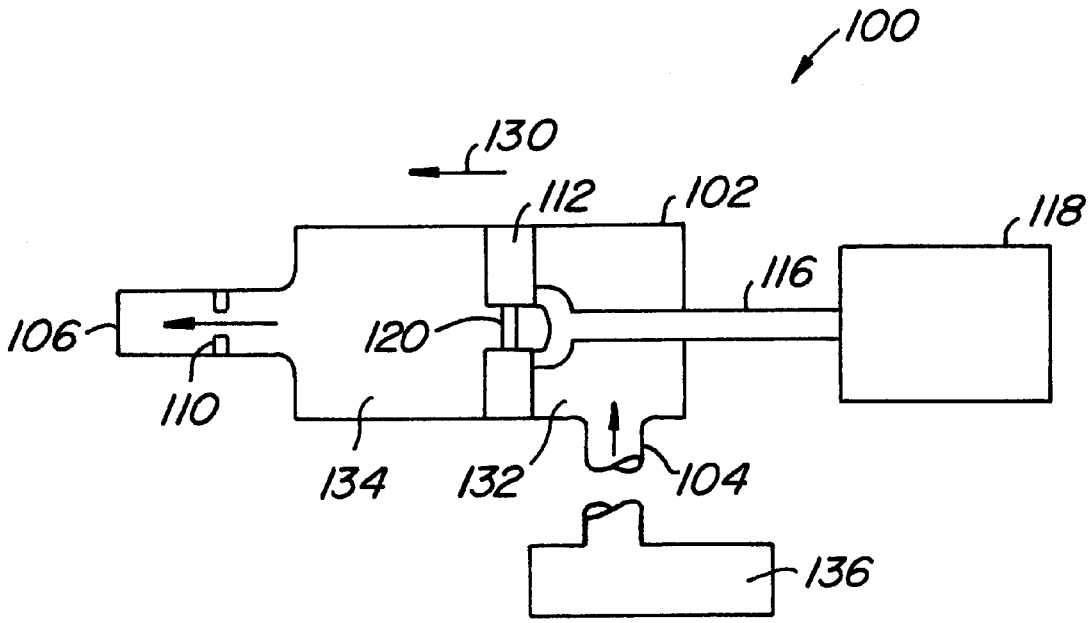
FIGS. 5A and 5B are schematic views illustrating operation of the pump of FIG. 4.
Figure 5B:
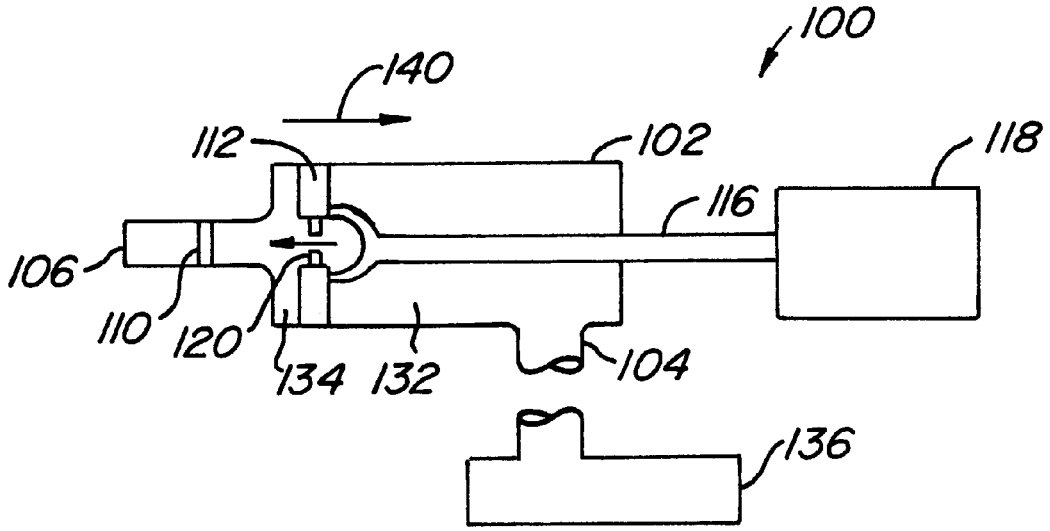

The air cylinder 118 drives the shaft 116 to move the piston 112 in a generally linear manner between two positions shown in FIGS. 5A and 5B. In FIG. 5A, the piston 112 is disposed at a first position near the inlet 104 moving away from the inlet 104 toward the outlet 106 in the direction indicated by the arrow 130. This causes the volume in the inlet chamber cavity portion 132 adjacent the inlet 104 to expand from its minimum level shown in FIG. 5A, and the pressure therein to drop. This produces a suction to draw condiment from the condiment source 136 through the inlet 104 to accumulate in the inlet chamber cavity portion 132. At the same time, the volume in the outlet chamber cavity portion 134 adjacent the outlet 106 decreases from its maximum level shown in FIG. 5A, and the pressure therein increases. The pressure buildup in the outlet chamber cavity portion 134 keeps the transfer check valve 120 closed to isolate the outlet chamber cavity portion 134 from the inlet chamber cavity portion 132. The piston seals 122 prevent condiment leakage between the cavity portions 132, 134. The pressure buildup also causes the outlet check valve 110 to open to release air or fluid contained therein.

In FIG. 5B, the piston 112 has moved to a second position near the outlet 106 where the inlet chamber cavity portion 132 reaches a maximum volume for accumulating condiment therein. The air cylinder 118 then moves the piston 112 via the shaft 116 away from the outlet 106 toward the inlet 104 in a direction indicated by the arrow 140. This causes the pressure in the outlet chamber cavity portion 134 to fall, which closes the outlet check valve 110 to prevent backflow through the outlet 106 into the outlet chamber cavity portion 134. As the volume of the inlet chamber cavity portion 132 decreases, the pressure therein rises. The pressure differential between the inlet chamber cavity portion 132 and the outlet chamber cavity portion 134 causes the transfer check valve 120 to open to permit condiment flow from the inlet chamber cavity portion 132 to the outlet chamber cavity portion 134. There is typically sufficient vacuum in the outlet chamber cavity portion 134 to draw the condiment from the inlet chamber cavity portion 132 so that there will be no backflow of condiment from the inlet chamber cavity portion 132 into the condiment source 136.

After the piston 112 is moved from the second position in FIG. 5B to the first position in FIG. 5A, an amount of the condiment is transferred from the inlet chamber cavity portion 132 to the outlet chamber cavity portion 134. That amount of condiment is dispensed out of the outlet chamber cavity portion 134 through the open outlet check valve 110 when the piston 112 is moved from the first position in FIG. 5A to the second position in FIG. 5B. Movement of the piston 112 reapportions the volume of the chamber cavity between the inlet chamber cavity portion 132 and the outlet chamber cavity portion 134. The reciprocating action of the air cylinder 118 for moving the piston 112 repeats the cycle of accumulating condiment in the inlet chamber cavity portion 132 and transferring condiment from the inlet chamber cavity portion 132 to the outlet chamber cavity portion 134 for dispensing through the outlet 106.

The piston stroke for the piston 112 is typically set at a level that provides a constant stroke, which produces a generally uniform accumulation of condiment for consistent dispensing in each cycle. The piston stroke can be adjusted by setting the limits of movement of the air cylinder 118 to select the desired amount of condiment for dispensing in each cycle. The portion control pump 100 provides a simple mechanism for reliably providing consistent portion control in dispensing condiments and the like.

Figure 6:
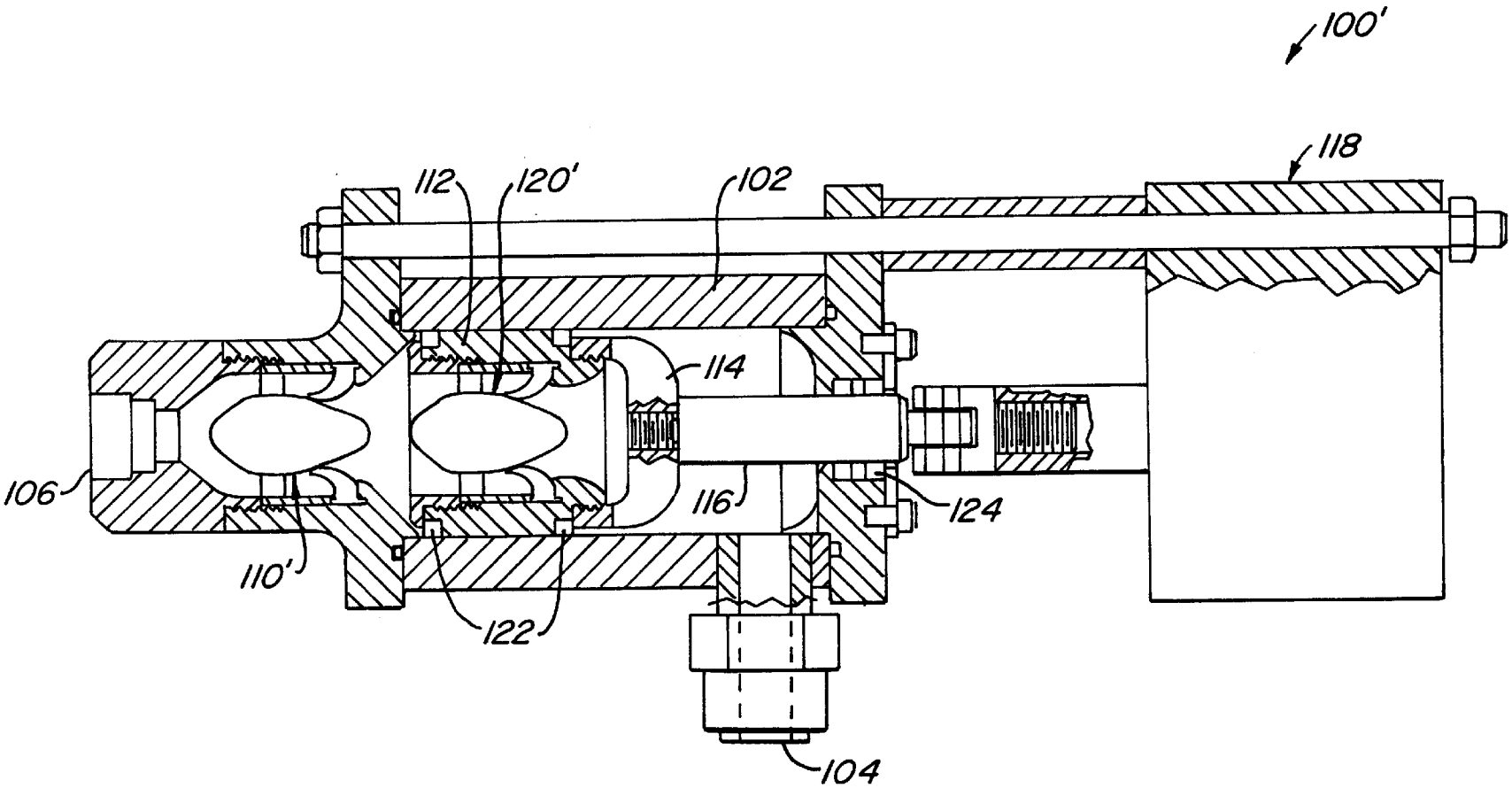
FIG. 6 is a cross-sectional view of a pump illustrating another embodiment of the present invention.

The above-described arrangements of apparatus and methods are merely illustrative of applications of the principles of this invention and many other embodiments and modifications may be made without departing from the spirit and scope of the invention as defined in the claims. For instance, FIG. 6 shows a portion control apparatus 100' in which both the outlet check valve 110' and the transfer check valve 120' are elastomeric check valves similar to that shown in FIGS. 1–3. In other embodiments, the outlet check valve and the transfer check valve may employ other types of check valves instead of the elastomeric check valve described above. Other drive mechanisms for moving the piston shaft can be used instead of the air cylinder. The piston shaft may also be operated manually. In addition, the chamber may have other shapes, and the piston may be configured to move in a nonlinear manner. Moreover, although the apparatus has been described in the context of condiment dispensing, the apparatus may be used for other fluids, including non-viscous fluids as well as viscous fluids such as beverages and water. The scope of the invention should, therefore, be determined not with reference to the above description, but instead should be determined with reference to the appended claims along with their full scope of equivalents.

What is claimed is:

1. A condiment dispensing pump comprising:

a pump chamber including a cavity having an inlet chamber cavity portion and an outlet chamber cavity portion, the pump chamber having an inlet fluidicly coupled with the inlet chamber cavity portion and an outlet fluidicly coupled with the outlet chamber cavity portion;

an outlet check valve disposed at or near the outlet of the pump chamber, the outlet check valve being openable to permit flow only in a direction from the outlet chamber cavity portion out through the outlet check valve; and a piston disposed in the pump chamber cavity between the inlet chamber cavity portion and the outlet chamber cavity portion, the piston being movable in the pump chamber cavity to reapportion the volume of the pump chamber cavity between the inlet chamber cavity portion and the outlet chamber cavity portion, the piston including a piston check valve which is openable to permit flow only in a direction from the inlet chamber cavity portion through the piston check valve to the outlet chamber cavity portion.

2. The condiment dispensing pump of claim 1 wherein the piston is movable between a first position when the inlet chamber cavity portion has a minimum volume and the outlet chamber cavity portion has a maximum volume, and a second position when the inlet chamber cavity portion has a maximum volume and the outlet chamber cavity portion has a minimum volume.

3. The condiment dispensing pump of claim 2 wherein the piston check valve is closed and the outlet check valve is open when the piston moves from the first position to the second position to draw a flow from the inlet into the inlet chamber cavity portion and to produce a flow from the outlet chamber cavity portion out through the outlet, and wherein the piston check valve is open and the outlet check valve is closed when the piston moves from the second position to the first position to permit flow from the inlet chamber cavity portion to the outlet chamber cavity portion and to prevent backflow through the outlet into the outlet chamber cavity portion.

4. The condiment dispensing pump of claim 3 wherein the piston is sealed with an interior wall of the pump chamber to prevent flow between the inlet chamber cavity portion and the outlet chamber cavity portion when the piston check valve is closed.

5. The condiment dispensing pump of claim 1 wherein the piston is movable in the pump chamber cavity in a generally linear manner.

6. The condiment dispensing pump of claim 1 wherein the piston has a generally constant stroke.

7. The condiment dispensing pump of claim 1 further comprising an air cylinder coupled with the piston to move the piston in the pump chamber cavity.

8. The condiment dispensing pump of claim 1 wherein the piston has a stroke which is adjustable.

9. A portion control dispensing apparatus comprising:

a chamber including a cavity having an inlet and an outlet;

an outlet check valve disposed at or near the outlet of the chamber, the outlet check valve being openable to permit flow only in a direction from the chamber cavity out through the outlet check valve; and a transfer check valve disposed in the chamber cavity, the transfer check valve being movable in the chamber cavity between a first position near the inlet and away from the outlet and a second position near the outlet and away from the inlet, the transfer check valve being closed when moved from the first position to the second position and being open when moved from the second position to the first position.

10. The apparatus of claim 9 wherein the outlet check valve is open when the transfer check valve is moved from the first position to the second position, and wherein the outlet check valve is closed when the transfer check valve is moved from the second position to the first position.

11. The apparatus of claim 10 wherein the transfer check valve is closed to block flow between two chamber cavity portions disposed on opposite sides of the transfer check valve when the transfer check valve is moved from the first position to the second position, and wherein the transfer check valve is open to permit flow from the chamber cavity portion adjacent the inlet to the chamber cavity portion adjacent the outlet when the transfer check valve is moved from the second position to the first position.

12. The apparatus of claim 11 wherein the outlet check valve is open and the transfer check valve is closed when the transfer check valve is moved from the first position to the second position in order to produce a predetermined amount of flow from the chamber cavity portion adjacent the outlet through the open outlet check valve.

13. The apparatus of claim 9 wherein the transfer check valve is movable in the chamber cavity in a generally linear manner.

14. The apparatus of claim 9 further comprising means for moving the transfer check valve in the chamber cavity.

15. The apparatus of claim 9 further comprising means for adjusting the first position and the second position of the transfer check valve.

16. A condiment dispensing pump comprising:

a pump chamber including a cavity having an upstream chamber cavity portion and a downstream chamber cavity portion, the pump chamber having an inlet fluidicly coupled with the upstream chamber cavity portion and an outlet fluidicly coupled with the downstream chamber cavity portion;

an outlet valve disposed at or near the outlet of the pump chamber;

a transfer valve disposed in the pump chamber cavity; and means for increasing the volume of the downstream chamber cavity portion and decreasing the volume of the upstream chamber cavity portion when the transfer valve is open and the outlet transfer valve is closed to transfer fluid accumulated in the upstream chamber cavity portion into the downstream chamber cavity portion, and for decreasing the volume of the downstream chamber cavity portion and increasing the volume of the upstream chamber cavity portion when the transfer valve is closed and the outlet valve is open to transfer the fluid in the downstream chamber cavity portion out through the open outlet valve and to draw fluid through the inlet for accumulation in the upstream chamber cavity portion.

17. The condiment dispensing pump of claim 16 wherein the outlet valve comprises an outlet check valve which is openable to permit flow only in a direction from the downstream chamber cavity portion out through the outlet check valve.

18. The condiment dispensing pump of claim 16 wherein the transfer valve comprises an transfer check valve which is openable to permit flow only in a direction from the upstream chamber cavity portion to the downstream chamber cavity portion.

19. The condiment dispensing pump of claim 16 wherein the piston has a piston body, and wherein the transfer valve is an elastomeric check valve which comprises:

a valve stem connected with the piston body, the valve stem having a contact surface;

a resilient valve member having a proximal portion attached to the piston body and a distal portion movable between a rest position and an open position, the distal portion being more flexible than the proximal portion, the resilient valve member having an upstream surface on an upstream side of the valve member and being at least partially exposed to the upstream chamber cavity portion, the resilient valve member having a downstream surface on the downstream side of the valve member and being at least partially exposed to the downstream chamber cavity portion, the resilient valve member comprising a flexible material which resiliently biases the valve member with a resilient biasing force toward the rest position and which is movable to the open position, the valve member having a sealing surface in the distal portion which is in contact with the contact surface of the valve stem in the rest position to prevent backflow from the downstream chamber cavity portion to the upstream chamber cavity portion, the sealing surface being spaced from the contact surface of the valve stem in the open position to permit fluid flow from the upstream chamber cavity portion to the downstream chamber cavity portion when the pressure in the upstream chamber cavity portion is sufficiently large compared to the pressure in the downstream chamber cavity portion to overcome the resilient biasing force.

20. The condiment dispensing pump of claim 16 wherein the piston has a piston body, and wherein the transfer valve is an elastomeric check valve which comprises:

a valve stem connected with the piston body;

a valve seal having a proximal portion attached to one of the piston body and the valve stem, the valve seal having a distal portion movable between a rest position and an open position, the valve seal being generally annular, the valve seal including a peripheral sealing surface in the distal portion, the sealing surface being in contact with a contact surface of the other of the piston body and the valve stem in the rest position to prevent backflow from the downstream chamber cavity portion to the upstream chamber cavity portion, the sealing surface being spaced from the contact surface in the open position to permit fluid flow from the upstream chamber cavity portion to the downstream chamber cavity portion when the pressure in the upstream chamber cavity portion is sufficiently large compared to the pressure in the downstream chamber cavity portion to separate the sealing surface from the contact surface.

21. The condiment dispensing pump of claim 16 wherein the piston has a piston body, and wherein the transfer valve is an elastomeric check valve which comprises:

a valve stem connected with the piston body;

a single-piece, elastomeric valve member disposed between the piston body and the valve stem, the valve member having a proximal portion attached to one of the piston body and the valve stem, the valve member having a distal portion movable between a rest position and an open position, the valve member including a sealing surface in the distal portion, the sealing surface being in contact with a contact surface of the other of the piston body and the valve stem in the rest position to prevent backflow from the downstream chamber cavity portion to the upstream chamber cavity portion, the sealing surface being spaced from the contact surface in the open position to permit fluid flow from the upstream chamber cavity portion to the downstream chamber cavity portion when the pressure in the upstream chamber cavity portion is sufficiently large compared to the pressure in the downstream chamber cavity portion to separate the sealing surface from the contact surface.

22. A method of providing portion control pumping comprising:

providing a transfer valve in a chamber between an inlet disposed at an inlet side of the chamber and an outlet disposed at an outlet side of the chamber;

providing an outlet valve at the outlet;

moving the transfer valve from the inlet side of the chamber to the outlet side of the chamber with the transfer valve closed and the outlet valve open to draw fluid through the inlet into the inlet side of the chamber and dispense fluid from the outlet side of the chamber out through the outlet; and moving the transfer valve from the outlet side of the chamber to the inlet side of the chamber with the transfer valve open and the outlet valve closed to transfer fluid from the inlet side of the chamber through the transfer valve to the outlet side of the chamber.

23. The method of claim 22 wherein the transfer valve is a transfer check valve which is open only in a direction from the inlet side of the chamber to the outlet side of the chamber when the pressure in the inlet side is sufficiently higher than the pressure in the outlet side of the chamber.

24. The method of claim 22 wherein the outlet valve is an outlet check valve which is open only in a direction from the outlet side of the chamber to an exterior side of the outlet when the pressure in the outlet side of the chamber is sufficiently higher than the pressure on the exterior side of the outlet.

* * * * *